US009731526B2

(12) United States Patent
Onodera

(10) Patent No.: US 9,731,526 B2
(45) Date of Patent: Aug. 15, 2017

(54) PRINTER

(71) Applicant: SATO HOLDINGS KABUSHIKI KAISHA, Tokyo (JP)

(72) Inventor: Hitoshi Onodera, Saitama (JP)

(73) Assignee: SATO HOLDINGS KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/107,307

(22) PCT Filed: Dec. 25, 2014

(86) PCT No.: PCT/JP2014/084314

§ 371 (c)(1),
(2) Date: Jun. 22, 2016

(87) PCT Pub. No.: WO2015/099041

PCT Pub. Date: Jul. 2, 2015

(65) Prior Publication Data

US 2017/0080726 A1 Mar. 23, 2017

(30) Foreign Application Priority Data

Dec. 26, 2013 (JP) ..... 2013-268260

(51) Int. Cl.
*B41J 15/04* (2006.01)
*B41J 11/27* (2006.01)

(52) U.S. Cl.
CPC ..... *B41J 15/04* (2013.01); *B41J 11/27* (2013.01)

(58) Field of Classification Search
None
See application file for complete search history.

(56) References Cited

U.S. PATENT DOCUMENTS 4,802,795 A 2/1989 Takada

FOREIGN PATENT DOCUMENTS

| | | | | |
|---|---|---|---|---|
| JP | 61-149381 | | | 7/1986 |
| JP | 63-41557 | U | | 3/1988 |
| JP | 63-68445 | U | | 5/1988 |
| JP | 4-45749 | U | | 4/1992 |
| JP | 5-80755 | U | | 11/1993 |
| JP | 6-71954 | A | | 3/1994 |
| JP | 11-5336 | A | | 1/1999 |
| JP | 2009166270 | A | * | 7/2009 |
| JP | 2011206969 | A | * | 10/2011 |

* cited by examiner

*Primary Examiner* — Lisa M Solomon
(74) *Attorney, Agent, or Firm* — Foley & Lardner LLP

(57) ABSTRACT

In a printer that performs printing on a label of a continuous paper while feeding the continuous paper unwound from a paper sheet supply unit, a platen roller portion is configured to be attachable and detachable only by operating an operating lever portion of an attaching and detaching operation portion. The attaching and detaching operation portion has its shaft fixed in a rotatable state between a bearing ring and a platen main body on one side in an axial direction of the platen roller portion. Pulling the operating lever portion of the attaching and detaching operation portion releases a locked state of the attaching and detaching operation portion itself and a locked state in the axial direction of the platen roller portion.

6 Claims, 19 Drawing Sheets

PRINTER

TECHNICAL FIELD

The present invention relates to a printer, for example, a printer having a label printing function that prints desired information, such as a character, a sign, a diagram, a barcode, or similar information, on a label or a similar print medium.

BACKGROUND ART

A label printer is a printer having a function that, for example, while unwinding a rolled continuous paper in a sheet-shape to feed the continuous paper, prints desired information on a label of the continuous paper.

This label printer has a printing portion, on which a thermal head portion and a platen roller portion are disposed facing to each other. The thermal head portion is a printing unit, which performs printing on the label. The platen roller portion is a member that feeds the continuous paper, and has its shaft axially supported in a rotatable state on a support frame inside the printer.

A structure regarding this platen roller portion is disclosed, for example, in JP5-80755U that discloses a technique to prevent a recording sheet from being rolled in again by disposing on both end sides in the axial direction of platen projecting portions that project to outer side than the outer diameter of a platen, and arranging these two projecting portions within the recording sheet width and on a downstream side in a paper feed direction with respect to the platen.

JP63-68445U, for example, discloses a technique to dispose a grip, which is used when attaching and detaching the platen, inside the frame axially supporting a platen shaft, and integrally with a cylindrical body axially supporting the platen shaft.

JP61-149381A, for example, discloses a technique to dispose a fixing rib, which is used when attaching and detaching the platen, inside the frame fixing the platen shaft, and integrally with a bearing of the platen shaft.

Furthermore, JP11-5336A, for example, discloses a structure to dispose an operational handle portion, which is used when attaching and detaching the platen, outside a side plate frame fixing the shaft of the platen.

SUMMARY OF INVENTION

In the techniques that the inventor has examined, when a platen roller portion is attached and detached, installation and removal using screws is required, which is a burdensome operation that consumes time and work.

The present invention has been made in view of the above-described technical background, and it is an object of the present invention to provide a technique that facilitates the attachment and detachment of the platen roller portion.

To solve the above-described problem, a printer according to a first aspect of the present invention includes a printing unit, a platen roller portion, a support body, and a medium guiding portion. The printing unit performs printing on a print medium while feeding the print medium supplied from a medium supply unit along a medium feed path. The platen roller portion is disposed at an opposite position of the printing unit in the medium feed path. The platen roller portion feeds the print medium along the medium feed path. The support body axially supports the platen roller portion in a rotatable state. The medium guiding portion guides feeding of the print medium to an upstream side of the feed with respect to the platen roller portion. The platen roller portion includes a platen main body, a platen shaft, bearing portions, and an operating portion. The platen shaft projects from both ends in an axial direction of the platen main body. The bearing portions are mounted on the platen shaft at each of both ends in the axial direction of the platen main body in a rotatable state. The bearing portions are supported by the support body. The operating portion is disposed in the platen shaft of the platen roller portion in a rotatable state. The operating portion operates to attach and detach the platen roller portion. The medium guiding portion is disposed with a depressed portion housing the operating portion.

A depressed portion to house the operating portion is disposed in a part within a feed surface of the medium guiding portion.

The operating portion includes an operating lever portion and a stopper portion disposed in a state being coupled to the operating lever portion. The stopper portion fixes the operating portion.

The stopper portion is disposed with a protrusion, and the support body is disposed with a depressed portion where the protrusion of the stopper portion fits.

The stopper portion is disposed such that a height of a top surface of the operating lever portion stops at a height that does not inhibit a move of the print medium being fed onto a top surface of the medium guiding portion when the operating portion is housed in the depressed portion.

The operating portion is disposed in a rotatable state between the platen main body and the bearing portion on one end side in a direction of the platen shaft.

A printer according to a second aspect of the present invention includes a printing unit, a platen roller portion, and a support body. The printing unit performs printing on a print medium while feeding the print medium supplied from a medium supply unit along a medium feed path. The platen roller portion is disposed at an opposite position of the printing unit in the medium feed path. The platen roller portion feeds the print medium along the medium feed path. The support body axially supports the platen roller portion in a rotatable state. The platen roller portion includes a platen main body, a platen shaft, bearing portions, and an operating portion. The platen shaft projects from both ends in an axial direction of the platen main body. The bearing portions are mounted on the platen shaft at each of both ends in the axial direction of the platen main body in a rotatable state. The bearing portions are supported by the support body. The operating portion operates to attach and detach the platen roller portion. The operating portion is disposed in a rotatable state between the platen main body and the bearing portion on one end side in a direction of the platen shaft.

A medium guiding portion that guides the feeding of the print medium to an upstream side of the feed with respect to the platen roller portion is included, and the medium guiding portion is disposed with a depressed portion to house the operating portion.

A depressed portion to house the operating portion is disposed in a part within a feed surface of the medium guiding portion.

The operating portion includes an operating lever portion, and a stopper portion disposed in a state being coupled to the operating lever portion. The stopper portion fixes the operating portion.

The stopper portion is disposed with a protrusion, and the support body is disposed with a depressed portion where the protrusion of the stopper portion fits.

The stopper portion is disposed such that a height of a top surface of the operating lever portion stops at a height that does not inhibit a move of the print medium being fed onto a top surface of the medium guiding portion when the operating portion is housed in the depressed portion.

According to the above-described aspect, operating the operating portion attaches and detaches the platen roller portion, which makes the attachment and detachment of the platen roller portion easier. Also, a simple structure can make the attachment and detachment of the platen roller portion easier. A dimension in the axial direction of the platen roller portion can be made small to downsize the printer. The operating lever portion can be set to a height position to function as a feed guide of the print medium without caring.

DESCRIPTION OF EMBODIMENTS

Figure 1:
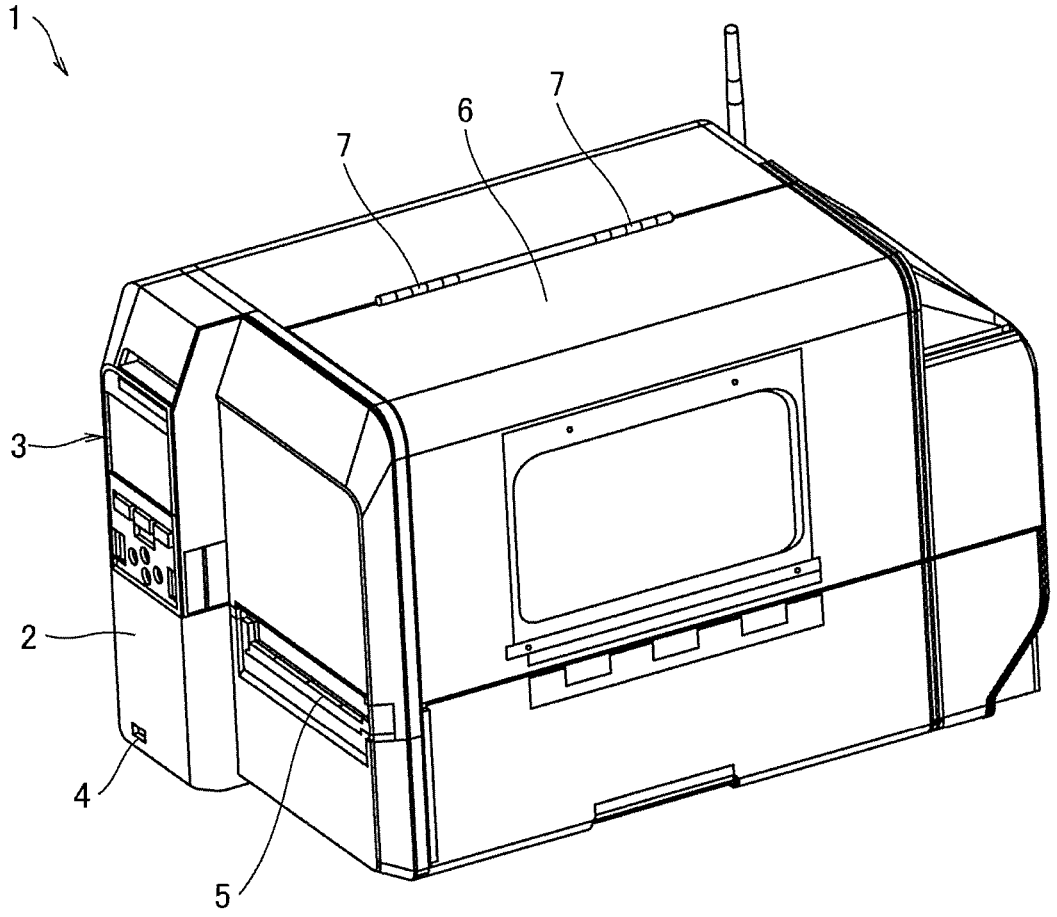
FIG. 1 is an overall perspective view of an appearance of a printer according to one embodiment of the present invention.

The following describes an embodiment as an example of the present invention in detail based on drawings. It should be noted that in the drawings to describe the embodiment, an identical reference numeral is basically attached to an identical component, and its repeated description is omitted.

A feed direction for printing a continuous paper (print medium), specifically a direction feeding the continuous paper from a paper sheet supply unit to a thermal head portion, is referred to as a printing direction, and if there is no specific description, an upstream in the feed direction is referred to as an upstream side in the printing direction, and a downstream in the feed direction is referred to as a downstream side in the printing direction.

FIG. 1 is an overall perspective view of an appearance of a printer according to the embodiment.

A printer 1 according to the embodiment has, for example, a label printing function, which prints information such as a character, a sign, a diagram, a barcode, or similar information, on a label adhered temporarily on a liner sheet of a continuous paper.

On a front cover portion 2 at a front of the printer 1, an operational panel unit 3, a power switch 4, and an issue port (medium discharge port) 5 are disposed.

On the operational panel unit 3, an LCD (Liquid Crystal Display), which displays a message or similar information, a plurality of keys (line key, feed key, function key, direction indicating key, cancel key, and similar keys), which operate an operation of the printer 1, and a plurality of LEDs (Light Emitting Diodes), which indicate a state of the printer 1, are disposed.

On one side surface of the printer 1, an open cover portion 6 is openably/closably mounted in a vertical direction by hinge portions 7 at two sites.

Figure 2:
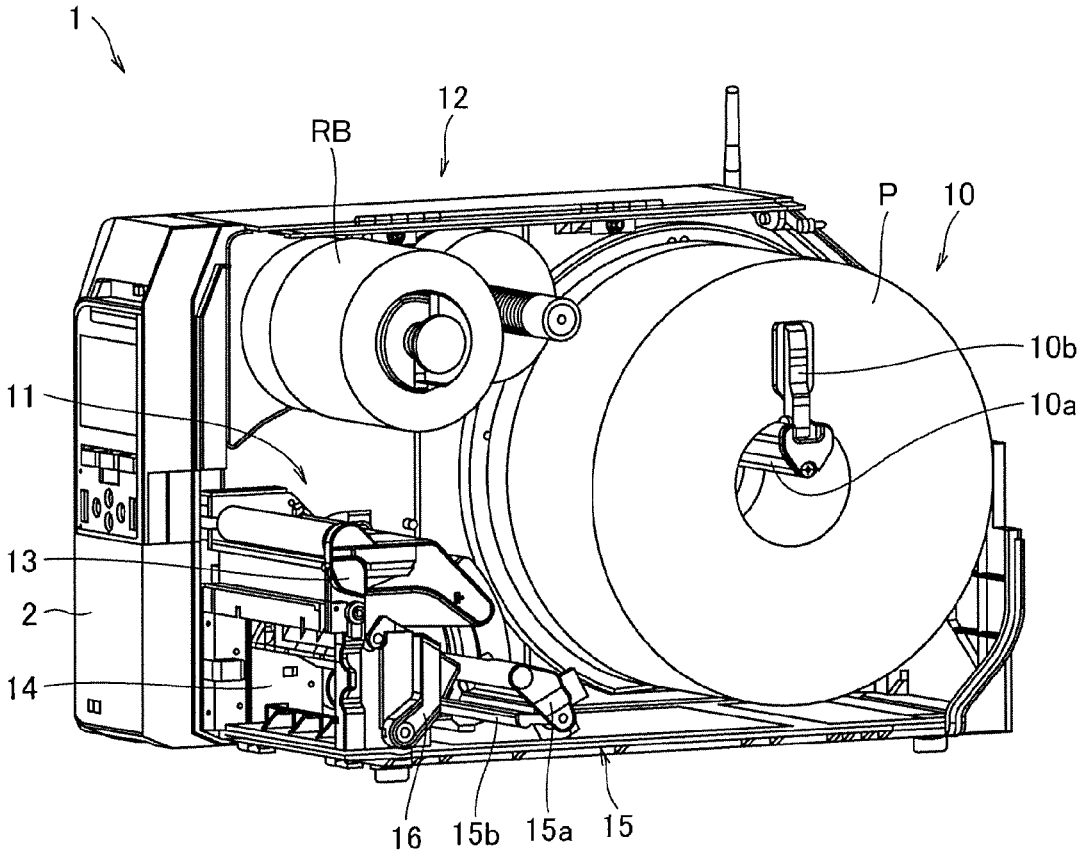
FIG. 2 is a perspective view for illustrating an inside of the printer in FIG. 1.
Figure 3:
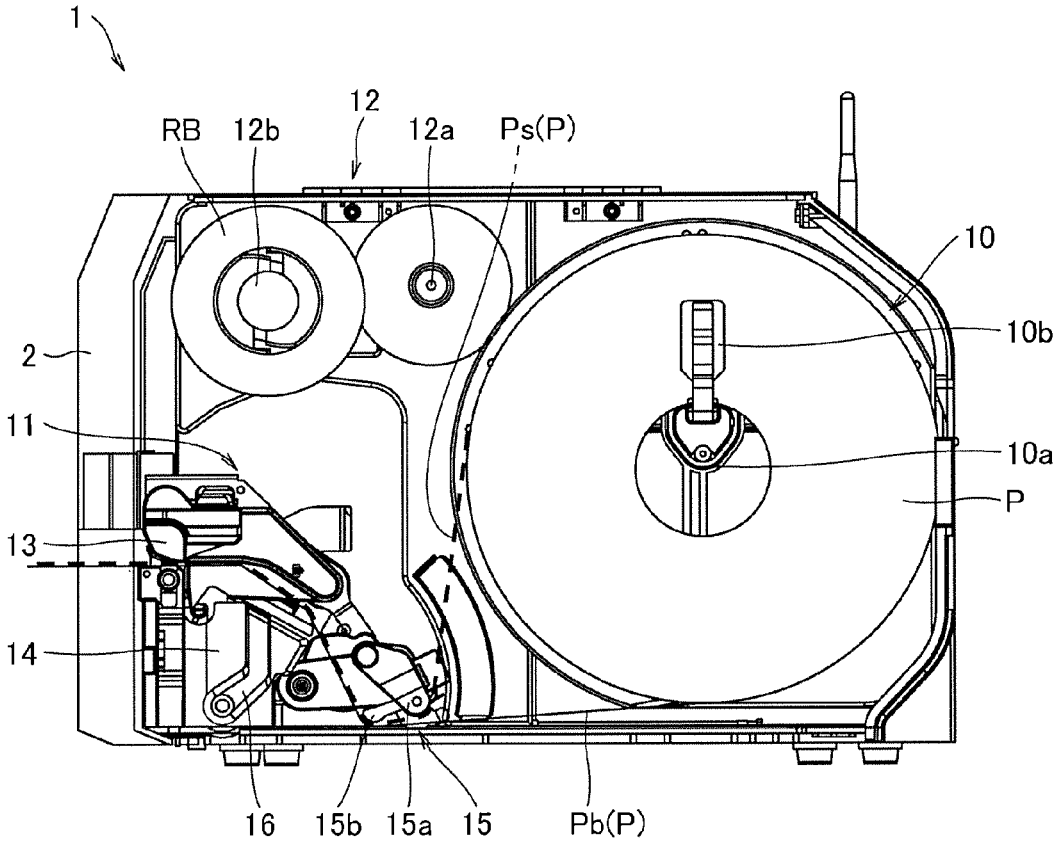
FIG. 3 is a side view of the printer in FIG. 2.

Next, an internal structure of the printer 1 will be described in reference to FIG. 2 and FIG. 3. FIG. 2 is a perspective view for illustrating an inside of the printer in FIG. 1, and FIG. 3 is a side view of the printer in FIG. 2. It should be noted that in the following description, a front side of the printer 1 (front cover portion 2 side) is referred to as a front (at a downstream side in the feed direction of the continuous paper), and its opposite side, a back side (back cover portion side) is referred to as a rear (at an upstream side in the feed direction of the continuous paper).

Inside the printer 1, a paper sheet supply unit (medium supply unit) 10, which is disposed on its rear, a printing portion 11, which is disposed on its front, and an ink ribbon portion 12, which is disposed on its upper side, are installed.

The paper sheet supply unit 10, which is a configuration unit that supplies a continuous paper (print medium) P to the printing portion 11, includes a support shaft 10*a* and a roll guiding portion 10*b*, which is installed at one end of the support shaft 10*a*.

The support shaft 10*a* is a configuration portion that rotatably supports the continuous paper P rolled up in a rolled-shape. The roll guiding portion 10*b*, which is a configuration portion that fixes the rolled continuous paper P, is movably installed along an axial direction of the support shaft 10*a* to be able to change its position corresponding to a width of the continuous paper P.

The continuous paper P includes, for example, a long liner sheet and a plurality of labels adhered temporarily at every predetermined interval along a longitudinal direction of the liner sheet. On a surface where an adhesive surface of the label contacts on the liner sheet, a releasing agent such as silicone or similar material is coated, and this ensures the label to be peeled off easily. On a surface where the label is not applied on the liner sheet, position detection marks, which indicate a position of the label, are formed at every predetermined interval along the longitudinal direction. For the label, there is a case where a thermal paper is used and a case where a plain paper is used. In the case of the thermal paper, on its surface, a thermal coloring layer, which develops a specific color (such as black or red) when reaching a predetermined temperature region, is formed.

There are two types of continuous papers P: an outside wound label and an inside wound label. The outside wound label is wound in a state where the label of the continuous paper P is positioned on an outer peripheral surface of the rolled continuous paper P, and as shown in FIG. 3, a continuous paper Ps (P: dashed line) is unwound from around the center in the height direction of the paper sheet supply unit 10 toward a bottom portion of the printing portion 11. In contrast, the inside wound label is wound in a state where the label of the continuous paper P is positioned on an inner peripheral surface side of the rolled continuous paper P, and as shown in FIG. 3, a continuous paper Pb (P: solid line) is unwound from around an internal bottom surface of the printer 1 toward the bottom portion of the printing portion 11. It should be noted that for both coated-side-out and coated-side-in, paper passing routes of the continuous paper P (Ps, Pb) in the printing portion 11 are identical. For both outside wound label and inside wound label, the continuous paper P is fed in a state where a surface where the label is temporarily adhered (printed surface) is upward.

The above-described printing portion 11, which is a configuration portion that performs printing on the label of continuous paper P or a similar print medium, includes a printing head portion 13, a supporting stand 14, which is disposed below the printing head portion 13, and a damper portion 15, which is disposed on a rear (upstream of feed of the continuous paper P at a printing process) of them.

The printing head portion 13 is, as described below, openably/closably installed inside the printer 1. When the printing head portion 13 is in a closed state, between the printing head portion 13 and the supporting stand 14, the paper passing route (medium feed path) is formed. Then, this paper passing route is coupled to the above-described issue port 5 (see FIG. 1).

On the supporting stand 14, a head lock lever portion 16, which maintains the closed state of the printing head portion 13, is installed. Operating this head lock lever portion 16 releases the closed state of the printing head portion 13 and then a front portion of the printing head portion 13 is lifted to open the printing head portion 13 (the printing head portion 13 separates from a platen roller portion 23).

The damper portion 15 is a configuration portion that gives tension to the continuous paper P. According to the embodiment, the damper portion 15 includes an outer damper portion 15*a* and an inner damper portion 15*b*. In the closed state of the printing head portion 13, the outer damper portion 15*a* and the inner damper portion 15*b* are swingably installed such that each can give tension to the continuous paper P.

The above-described ink ribbon portion 12, which is a configuration portion that supplies and rolls up an ink ribbon where printing ink is applied, includes a ribbon supply unit 12*a* and a ribbon roll up unit 12*b*, which is disposed on a lateral of a front of the ribbon supply unit 12*a*. The ribbon supply unit 12*a* is a configuration unit that rotatably supports the ink ribbon rolled up in a rolled-shape. The ribbon roll up unit 12*b* is a configuration unit that rolls up and recovers the already printed ink ribbon RB. It should be noted that when using the ink ribbon, the ink ribbon extracted from the ribbon supply unit 12*a* is passed through below the printing head portion 13, and then rolled up by the ribbon roll up unit 12*b*.

According to such printer 1, the continuous paper P (Ps, Pb), which is unwound from the paper sheet supply unit 10 in a sheet-shape, is fed to the paper passing route between the printing head portion 13 and the supporting stand 14 via the damper portion 15, and in the middle of this, after a printing process is executed on the label of the continuous paper P or a similar print medium, is discharged outside the printer 1 from the issue port 5.

Figure 4:
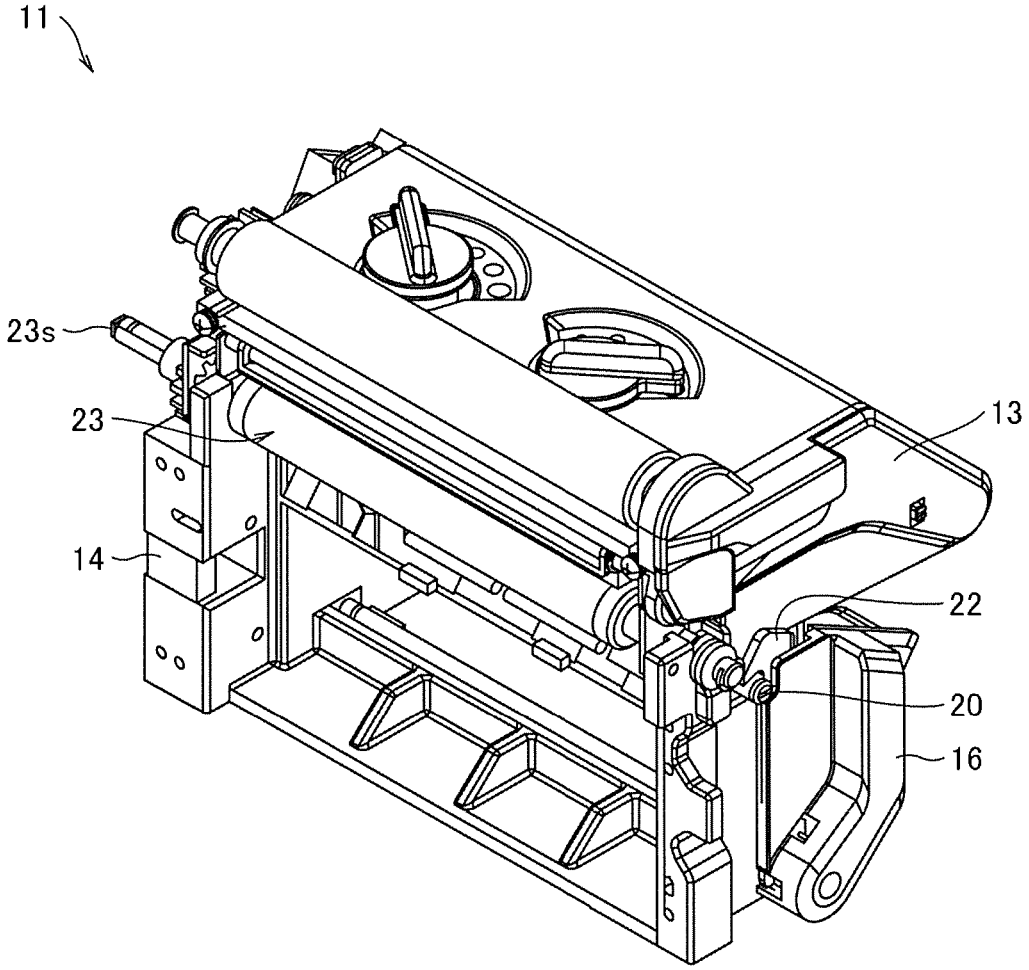
FIG. 4 is an enlarged perspective view where a printing portion in FIG. 3 is viewed from a front side.
Figure 5:
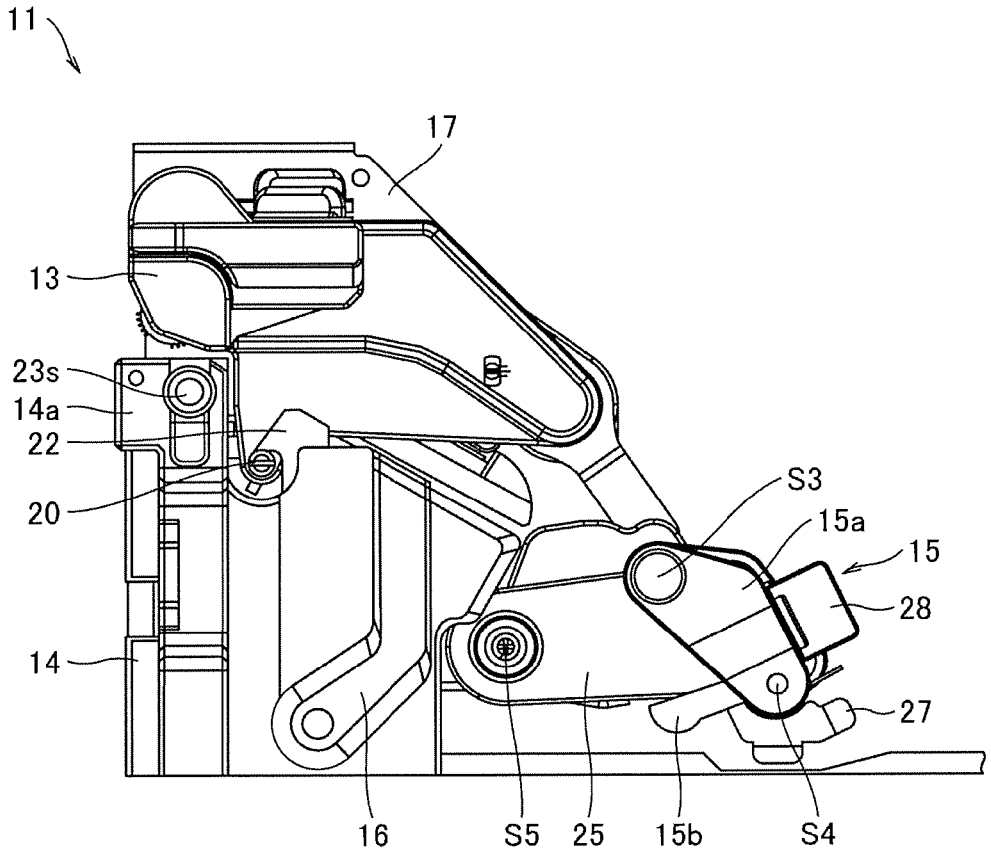
FIG. 5 is a side view of the printing portion in FIG. 4.
Figure 6:
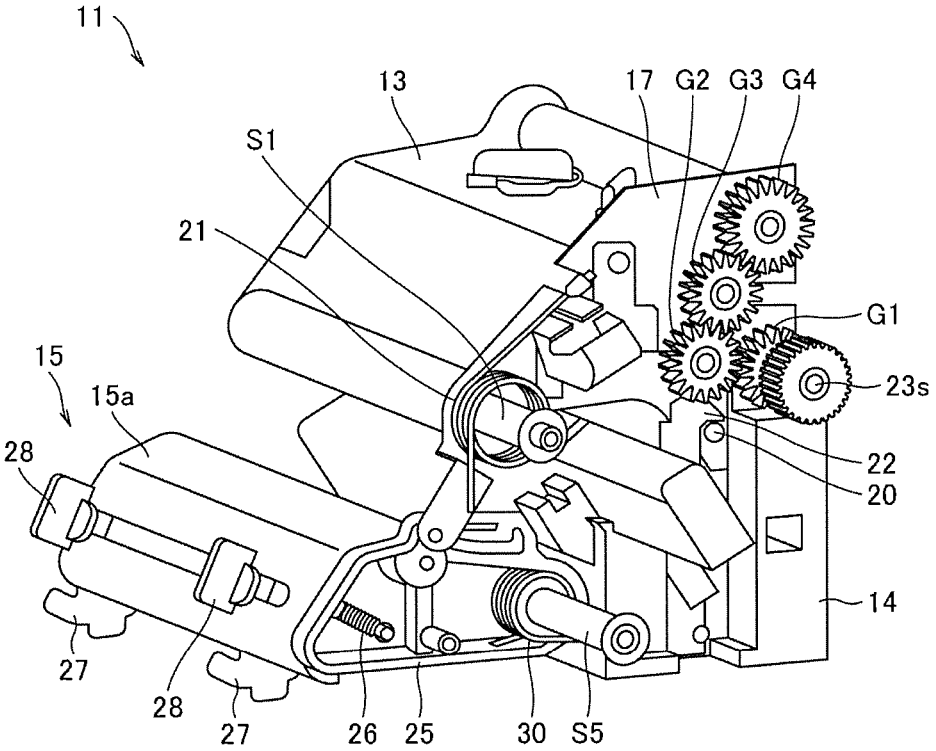
FIG. 6 is a perspective view where the printing portion in FIG. 4 is viewed from a back side.
Figure 7A:
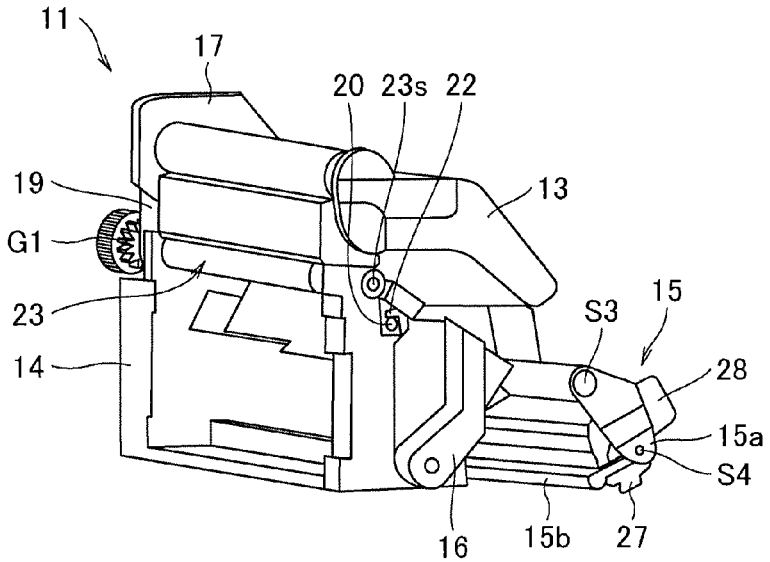
FIG. 7A is a perspective view where the printing portion in a closed state of a printing head portion in FIG. 4 is viewed from a front.
Figure 7B:
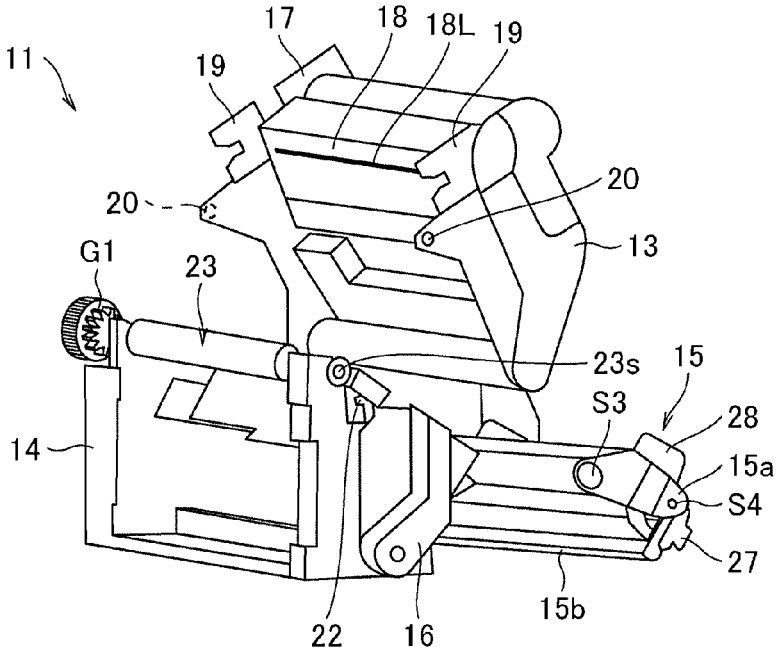
FIG. 7B is a perspective view where the printing portion in an open state of the printing head portion in FIG. 4 is viewed from the front.
Figure 8:
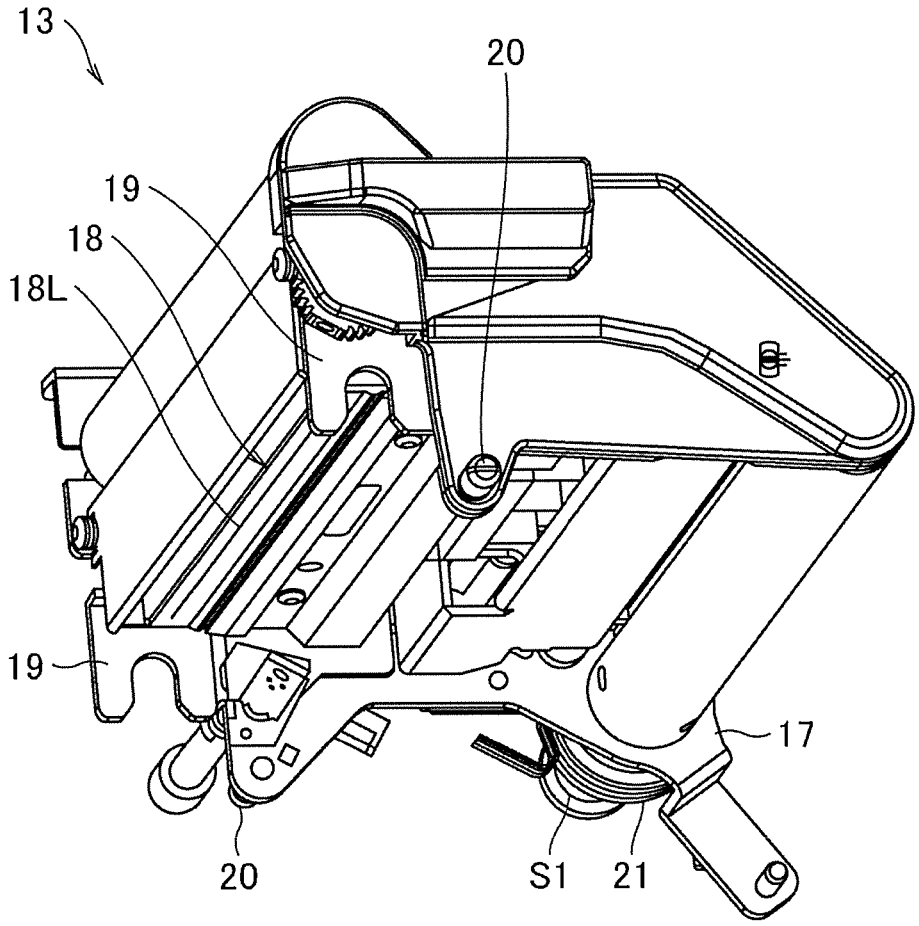
FIG. 8 is a perspective view where the printing head portion in FIG. 4 is extracted, and then viewed from a lower side.
Figure 9:
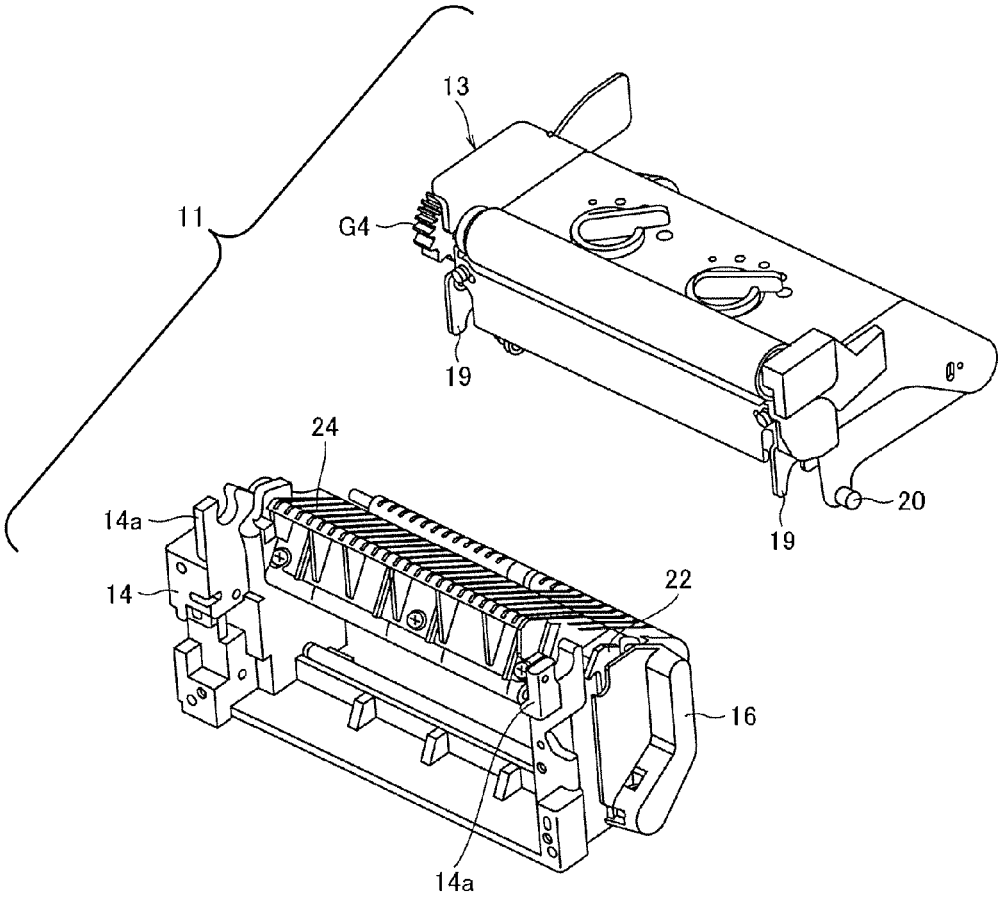
FIG. 9 is an exploded perspective view of the printing portion in FIG. 4.

Next, a configuration of the above-described printing portion 11 will be described with reference to FIG. 4 to FIG. 9. FIG. 4 is an enlarged perspective view where the printing portion in FIG. 3 is viewed from a front, FIG. 5 is a side view of the printing portion in FIG. 4, FIG. 6 is a perspective view where the printing portion in FIG. 4 is viewed from a back side, FIG. 7A is a perspective view where the printing portion in a closed state of a printing head portion in FIG. 4 is viewed from a front, FIG. 7B is a perspective view where the printing portion in an open state of the printing head portion in FIG. 4 is viewed from the front, FIG. 8 is a perspective view where the printing head portion in FIG. 4 is extracted, and then viewed from a lower side, and FIG. 9 is an exploded perspective view of the printing portion in FIG. 4.

The printing head portion 13 includes the front portion, which is swingably in the vertical direction (that is, openably and closably) supported by a head support plate 17 on one side surface of the printing head portion 13 around a rotary shaft S1 (see FIG. 6 and FIG. 8) of a rear of the printing head portion 13.

On an inferior surface (surface facing the paper passing route) of the printing head portion 13, a thermal head portion 18 (see FIG. 7B and FIG. 8) is installed in a state where its printing surface faces the paper passing route. The thermal head portion 18 is a printing unit, which performs printing on the label of the continuous paper P and similar print medium with heating resistors of a printing line 18L disposed on a printing surface of the thermal head portion 18. On this printing line 18L, a plurality of heating resistors (heating elements), which generates heat by energization, are arranged along a width direction (direction perpendicular to the feed direction of the continuous paper P) of the continuous paper P.

On an inferior surface of a front side of the printing head portion 13, depressed claw portions 19, 19 (see FIG. 7B and FIG. 8) are disposed so as to sandwich the thermal head portion 18. On the inferior surface of the printing head portion 13, pins 20, 20, which project outward from both side surfaces of the printing head portion 13, are disposed on rear of the depressed claw portions 19.

While such printing head portion 13 is biased in the opening direction by a torsion spring 21 mounted on the rotary shaft S1 (see FIG. 6 and FIG. 8), the printing head portion 13 is maintained to be in a closed state with lock claw portions 22, 22 of the supporting stand 14 being hooked in the pins 20, 20 on a lower portion of the printing head portion 13. Pulling the above-described head lock lever portion 16 rightward in FIG. 5 moves the lock claw portions 22 rightward in FIG. 5 along with this, thus unhooking the lock claw portions 22 from the pins 20. Unhooking the lock claw portions 22 from the pins 20, as shown in FIG. 7B, automatically opens the printing head portion 13 by biasing force of the torsion spring 21.

In the closed state of the printing head portion 13, while the depressed claw portions 19, 19 of the printing head portion 13 (see FIG. 7B and FIG. 8) are fitted on both end portions of a platen shaft 23*s* of the platen roller portion 23 (see FIG. 4, FIG. 7A, FIG. 7B, and FIG. 5), a printing surface of the thermal head portion 18 are pressed on the platen roller portion 23 (see FIG. 4, FIG. 7A, and FIG. 7B), which is below the thermal head portion 18, by a pressing device disposed on the printing head portion 13.

The platen roller portion 23, which is a feeding unit that feeds the continuous paper P unwound from the paper sheet supply unit 10 to the issue port 5 (see FIG. 1) along the paper passing route, has its shaft axially supported on support frames 14*a* of the supporting stand 14 (see FIG. 5 and FIG. 9) rotatably in normal and reverse directions.

To one end in an axial direction of the platen shaft 23*s* of the platen roller portion 23, a gear G1 (see FIG. 6) is coupled. The platen shaft 23*s* of this gear G1 side, for example, is engaged with a rotary shaft of a driver (not illustrated) such as a stepping motor via such as a timing belt (not illustrated). The gear G1 is coupled to a gear G4 via concatenation gears G2 and G3 (see FIG. 6).

On a top surface of the supporting stand 14, a paper sheet guiding portion (medium guiding portion: see FIG. 9) 24, which guides the feed of the continuous paper P, is installed at an upstream of feed with respect to the platen roller portion 23. This paper sheet guiding portion 24 is installed in an inclined state where a height at its top surface increases from the upstream of feed to a downstream of feed. The platen roller portion 23 and the paper sheet guiding portion 24 will be later described in detail.

It should be noted that in the paper passing route of the printing portion 11, between the thermal head portion 18 and the damper portion 15, a paper-sheet-position detecting sensor (not illustrated) is disposed. This paper-sheet-position detecting sensor, which is a sensor that detects a label position of the continuous paper P by detecting the position detection mark formed on the continuous paper P or a liner sheet part between adjacent labels, for example, is constituted of a light reflection type or light transmission type sensor.

At the printing process, the continuous paper P is fed by rotating the platen roller portion 23 in a state where the thermal head portion 18 is pressed toward the platen roller portion 23, while the continuous paper P is sandwiched between the thermal head portion 18 and the platen roller portion 23. Then, based on information detected by the paper-sheet-position detecting sensor, a printing timing is determined, and the heating resistors of the printing line 18L are selectively heated by a printing signal transmitted to the thermal head portion 18. Thus, desired information, such as a character, a sign, a diagram, a barcode, or similar information, is printed on the label of the continuous paper P in the middle of feeding the continuous paper P.

On the other hand, the outer damper portion 15*a* of the damper portion 15, when viewing a side surface of the printing portion 11, extends obliquely downward from a front side to a rear side, and is supported by a damper supporting member 25 around a rotary shaft S3 of the front side (see FIG. 5, FIG. 7A, and FIG. 7B) in a state where the rear portion is swingable in the vertical direction. It should be noted that a coil spring 26 in FIG. 6 is a member that inhibits the outer damper portion 15*a* from going excessively to an upper side (rear side), swingably supports the outer damper portion 15*a*.

The inner damper portion 15*b* of the damper portion 15, when viewing the side surface of the printing portion 11, extends obliquely downward from the rear side to the front side in contrast to the outer damper portion 15*a*, and is supported by the rear portion of the outer damper portion 15*a* around a rotary shaft S4 (see FIG. 5, FIG. 7A, and FIG. 7B) on the rear side in a state where a front portion is swingable in the vertical direction.

At the printing process, a paper sheet contact portion of the inner damper portion 15*b* is positioned on a downstream of feed of the continuous paper P with respect to a paper sheet contact portion of the outer damper portion 15*a*. That is, the paper sheet contact portion of the inner damper portion 15*b* is disposed between the printing head portion 13 and the paper sheet contact portion of the outer damper portion 15*a*.

At a phase before passing through the paper, a height of the paper sheet contact portion of the inner damper portion 15*b* is disposed at a lower position than a height of the paper sheet contact portion of the outer damper portion 15*a*. That is, the height of the paper sheet contact portion of the inner damper portion 15*b* is disposed between the paper sheet contact portion of the outer damper portion 15*a* and a bottom surface inside of the printer 1.

On a lower portion of the outer damper portion 15*a*, a width adjustment guiding portion 27 is movably installed along an axial direction of the rotary shafts S3 and S4. The width adjustment guiding portion 27 is a configuration portion that abuts on both ends of the width direction of the continuous paper P fed from the paper sheet supply unit 10, and guides the feed of the continuous paper P. This width adjustment guiding portion 27 is coupled to a guide operating portion 28 on a back side of the outer damper portion 15*a*. This guide operating portion 28 is a tab for, while moving the width adjustment guiding portion 27 according to the width of the continuous paper P, fixing a position of the width adjustment guiding portion 27.

The damper supporting member 25, which supports the outer damper portion 15*a* of such damper portion 15, is supported within the printer 1 around of a rotary shaft S5 (see FIG. 5 and FIG. 6) on a front portion side in a state where a rear portion is swingable in a vertical direction.

The rear portion of the damper supporting member 25 is biased in a direction opening upward around the rotary shaft S5 (see FIG. 5 and FIG. 6) by a torsion spring 30 (see FIG. 6) mounted on the rotary shaft S5 (direction where the entire damper portion 15 is lifted).

Figure 10:
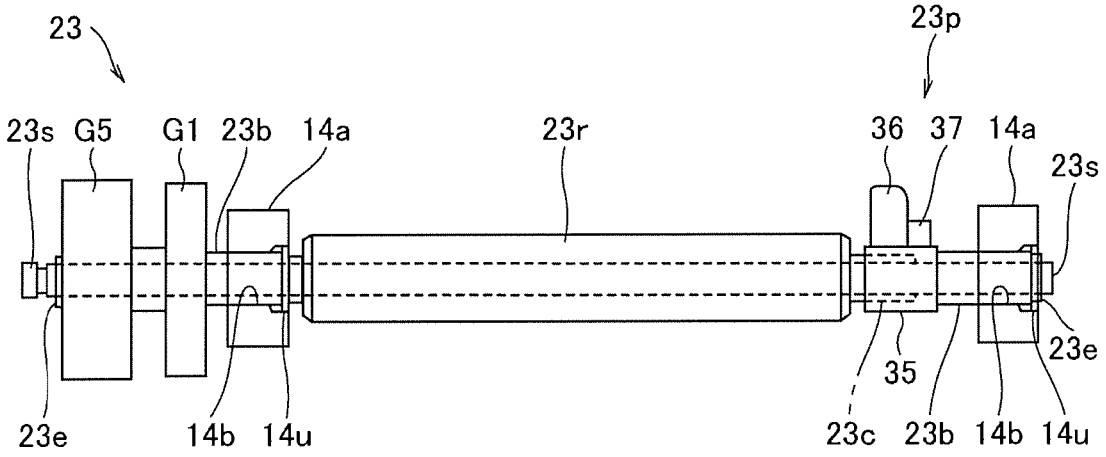
FIG. 10 is a plan view of a platen roller portion viewed from above.
Figure 11:
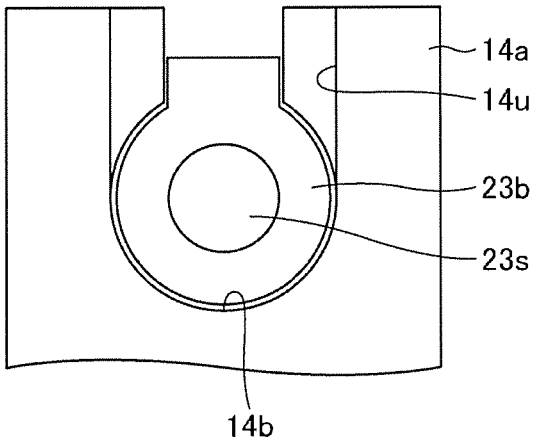
FIG. 11 is a main part side view of a support frame supporting the platen roller portion.
Figure 12:
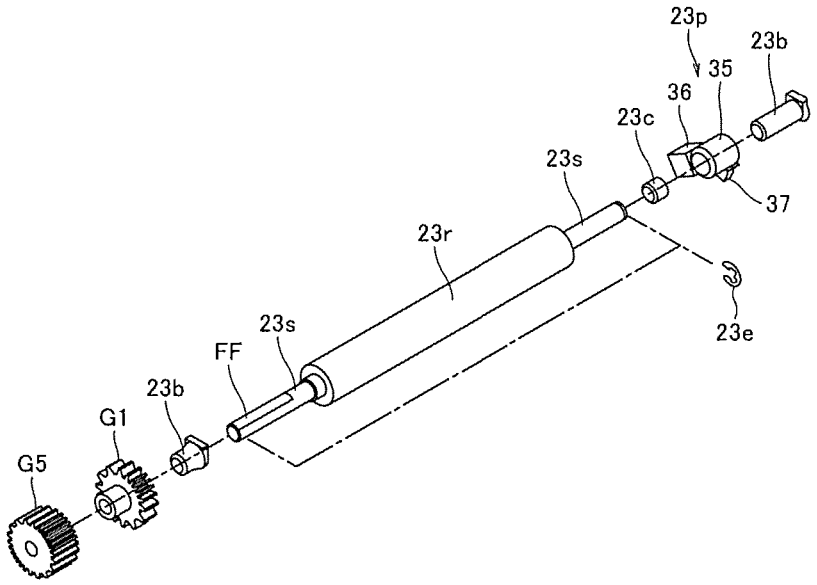
FIG. 12 is an exploded perspective view of the platen roller portion in FIG. 10.
Figure 13:
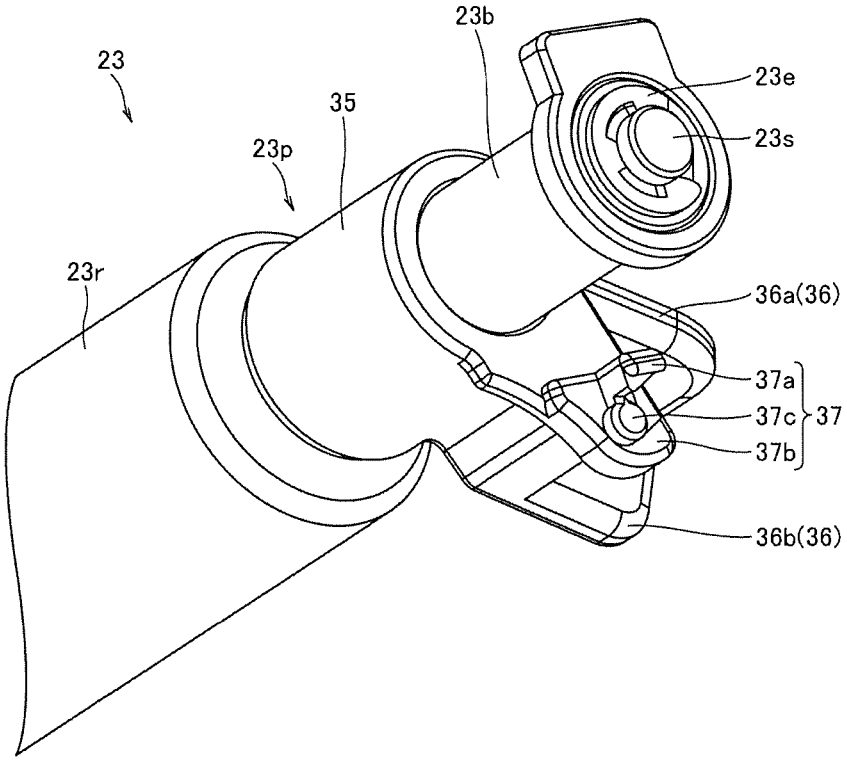
FIG. 13 is a main part perspective view of an attaching and detaching operation portion of the platen roller portion in FIG. 10 viewed from a front lower side.
Figure 14:
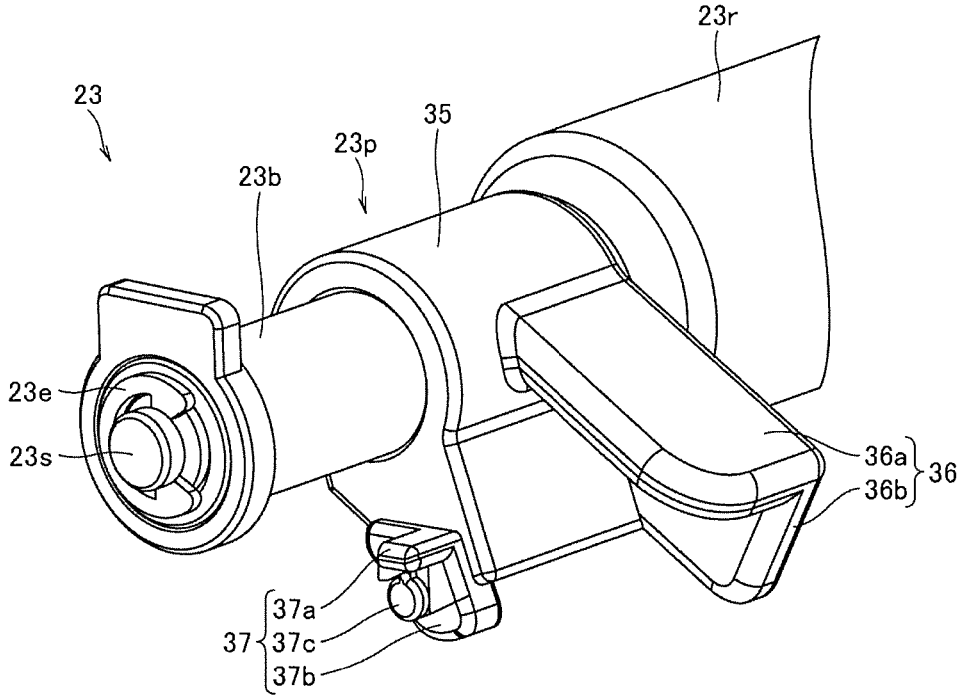
FIG. 14 is a main part perspective view of the attaching and detaching operation portion of the platen roller portion in FIG. 10 viewed from a back upper side.
Figure 15:
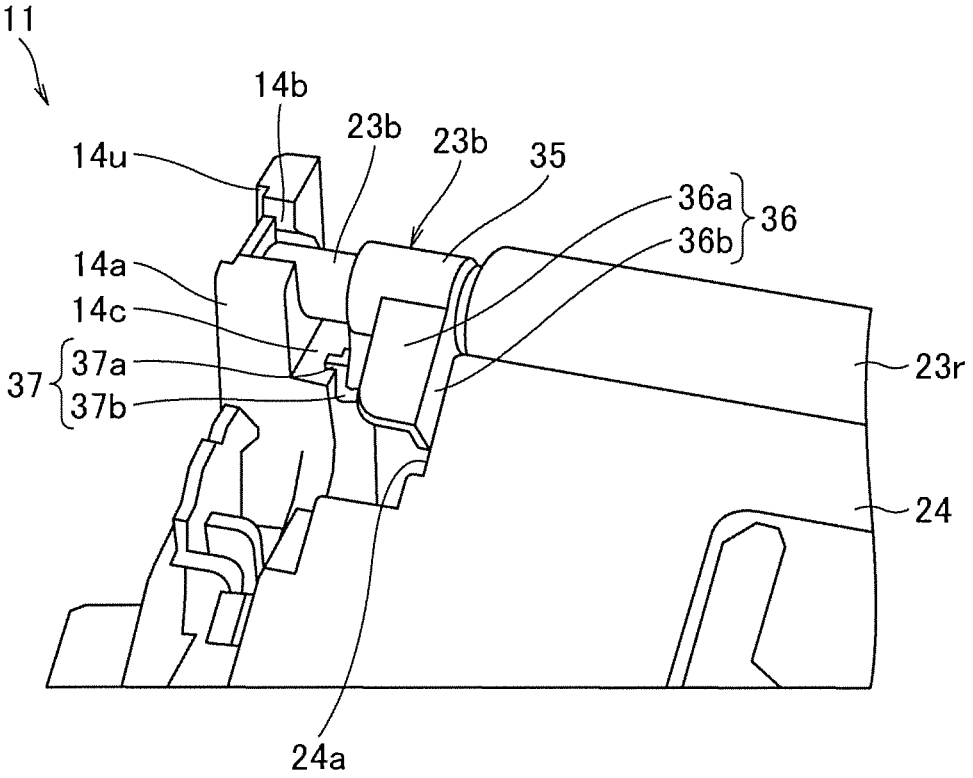
FIG. 15 is a perspective view of a corner portion of a supporting stand which constitutes the printing portion of the printer.
Figure 16:
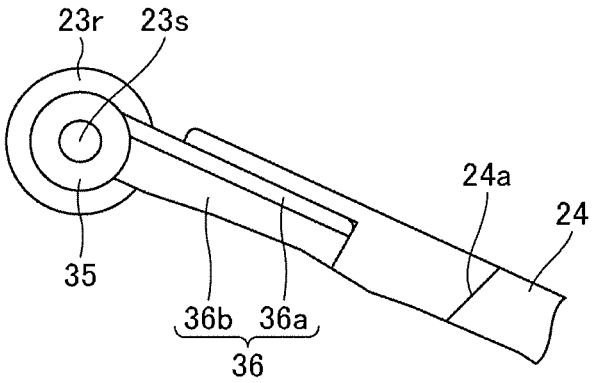
FIG. 16 is a main part side view for illustrating a height relation of a top surface between the attaching and detaching operation portion of the platen roller portion and a paper sheet guiding portion.
Figure 17:
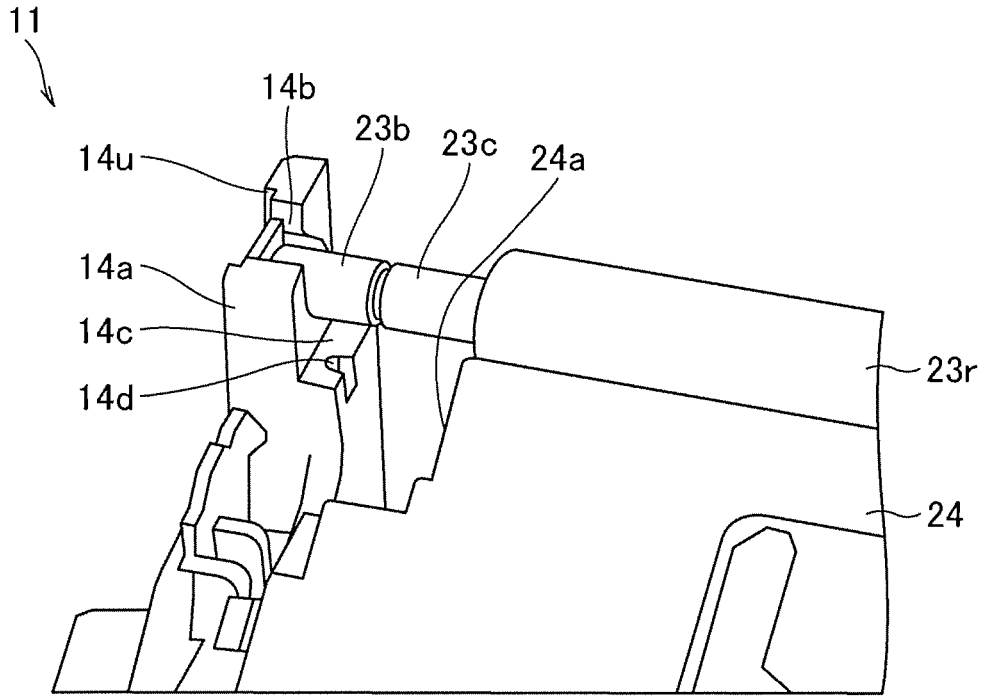
FIG. 17 is a main part perspective view of the corner portion of the supporting stand where the attaching and detaching operation portion is removed from FIG. 15.

Next, the platen roller portion 23 will be described in reference to FIG. 10 to FIG. 17. FIG. 10 is a plan view of a platen roller portion viewed from above; FIG. 11 is a main part side view of a support frame supporting the platen roller portion; FIG. 12 is an exploded perspective view of the platen roller portion in FIG. 10; FIG. 13 is a main part perspective view of an attaching and detaching operation portion of the platen roller portion in FIG. 10 viewed from a front lower side; FIG. 14 is a main part perspective view of the attaching and detaching operation portion of the platen roller portion in FIG. 10 viewed from a back upper side; FIG. 15 is a perspective view of a corner portion of a supporting stand which constitutes the printing portion of the printer; FIG. 16 is a main part side view for illustrating a height relation of a top surface between the attaching and detaching operation portion of the platen roller portion and a paper sheet guiding portion; FIG. 17 is a perspective view of the corner portion of the supporting stand where the attaching and detaching operation portion in FIG. 15 is removed.

The platen roller portion 23 has a platen main body 23*r*, the platen shaft 23*s*, bearing rings (bearing portions) 23*b*, 23*b*, gears G1, G5, an attaching and detaching operation portion (operating portion) 23*p*, a collar ring 23*c* and E-rings 23*e*, 23*e*.

The platen main body 23*r* is, for example, formed of an elastic material such as an elongated cylindrical-shaped rubber. The above-described printing surface of the thermal head portion 18 is pressed onto the platen main body 23*r* of the platen roller portion 23.

The platen shaft 23*s* is, for example, formed of an elongated column-shaped metal, and is inserted and fixed inside a pipe of the platen main body 23*r* in a state where both end portions in the longitudinal direction of the platen shaft 23*s* are projecting from both ends in the axial direction of the platen main body 23*r*.

The bearing rings 23*b*, 23*b* are members to axially support a shaft of the platen roller portion 23 on the support frames 14*a* rotatably. The bearing rings 23*b*, 23*b* are, for example, formed of a cylindrically-shaped metal, and are mounted on each side of both ends in the axial direction of the platen shaft 23*s* rotatably.

One end face in the axial direction of each of the bearing rings 23*b*, 23*b* is, as illustrated in FIG. 11, formed to have a shape that combines a circular shaped portion and a rectangular shaped portion, which projects in a radial direction from a part of an outer periphery of the circular shaped portion. On the other hand, each support frame 14*a*, 14*a* is formed with U-shaped grooves 14*u* and grooves 14*b* in an order, along the platen shaft 23*s*. The grooves 14*b* are formed to have shapes that combine a circular-shaped groove portion and a rectangular-shaped groove extending in a radial direction from a part of an outer periphery of the circular-shaped groove portion.

When mounting the platen roller portion 23 on the support frames 14*a*, after putting each of the bearing rings 23*b*, 23*b* into the U-shaped grooves 14*u* of the support frames 14*a*, move the bearing rings 23*b*, 23*b* toward the grooves 14*b* along the axial direction of the platen shaft 23*s* to fit in the grooves 14*b*. This fixes each of the bearing rings 23*b*, 23*b* on the support frames 14*a*, 14*a* so as not to rotate. It should be noted that, in FIG. 11, the E-ring 23*e* is omitted to make the drawing easily viewable.

On the platen shaft 23*s* on the one end side in the axial direction of the platen roller portion 23 (the left side in FIG. 12), gears G1, G5 are connected to the leading end side with respect to an installation position of the bearing ring 23*b*. A part of an outer periphery of the platen shaft 23*s* on this one end side is formed with a flat surface FF (see FIG. 12) along the axial direction. The gears G1, G5 are fixed to the platen shaft 23*s* by being mounted on the position of the flat surface FF of the platen shaft 23*s*. It should be noted that the leading end side with respect to the gear G5 of the platen shaft 23*s* on this one end side is mounted with the E-ring 23*e*. This prevents the bearing ring 23*b* and the gears G1, G5 from being detached.

On the other hand, on the platen shaft 23*s* on the other end side in the axial direction of the platen roller portion 23 (the right side in FIG. 12), the attaching and detaching operation portion 23*p* is mounted between the platen main body 23*r* and the bearing ring 23*b* rotatably via the collar ring 23*c* in the inner periphery of the attaching and detaching operation portion 23*p*. It should be noted that, on the platen shaft 23*s* on the other end side, the leading end side with respect to the bearing ring 23*b* is mounted with the E-ring 23*e*. This prevents the bearing ring 23*b*, the attaching and detaching operation portion 23*p* and the collar ring 23*c* from being detached.

The attaching and detaching operation portion 23*p* is a member to operate attachment and detachment of the platen roller portion 23. The attaching and detaching operation portion 23*p* is, for example, formed of a plastic, and is integrally included a rotary shaft 35, an operating lever portion 36 and a stopper portion 37.

The rotary shaft 35 is, for example, formed to be cylindrical-shaped. The platen shaft 23*s* is inserted into the pipe of the rotary shaft 35 via the collar ring 23*c*. The collar ring 23*c* is a member that axially supports the shaft of the attaching and detaching operation portion 23*p* on the platen shaft 23*s* rotatably, and that prevents the attaching and detaching operation portion 23*p* from moving toward the platen main body 23*r*.

The operating lever portion 36 is a portion to be held by a human hand, and extends toward the outside (the radial direction) from the outer peripheral surface of the rotary shaft 35. The operating lever portion 36 integrally includes a top surface portion 36*a* and a side surface portion 36*b* that is perpendicular to the top surface portion 36*a*. That is, the operating lever portion 36 has a cross-section crossing its longitudinal direction formed to be L-shaped. This ensures both the mechanically strengthened and downsized operating lever portion 36.

The stopper portion 37 has a function to prevent a rotation of the attaching and detaching operation portion 23*p*, and to lock the platen roller portion 23 by preventing the platen roller portion 23 from moving in the axial direction. The stopper portion 37 is disposed at a position apart by a predetermined angle in a circumferential direction with respect to the operating lever portion 36 on the outer peripheral surface of the rotary shaft 35. The angle of the stopper portion 37 separating from the operating lever portion 36 is between 0 degrees and 90 degrees, for example, approximately 45 degrees. When the attaching and detaching operation portion 23*p* is locked, the stopper portion 37 is disposed to position slightly in the upstream side of feed with respect to the platen shaft 23*s*.

The stopper portion 37 includes a top surface portion 37*a*, a side surface portion 37*b* that is perpendicular to the top surface portion 37*a*, and a protrusion 37*c* that is disposed on the side surface portion 37*b* (see FIG. 13 and FIG. 14). When the platen roller portion 23 is locked (in a state where the operating lever portion 36 is down), the top surface portion 37*a* and the side surface portion 37*b* of the stopper portion 37 are in contact with a top surface and a side surface of a shoulder portion 14*c* of the support frames 14*a* respectively.

When the platen roller portion 23 is locked (in a state where the operating lever portion 36 is down), the protrusion 37*c* of the stopper portion 37 is fitted in a groove (depressed portion) 14*d* (see FIG. 17) on the shoulder portion 14*c*. This prevents the attaching and detaching operation portion 23*p* from rotating. The groove 14*d* is disposed to position slightly in the upstream side of feed with respect to the platen shaft 23*s* corresponding to the stopper portion 37 as described above.

The top surface portion 37*a* of the stopper portion 37 may be formed to be wide to cover the whole upper side of the protrusion 37*c*, however, the width may be narrow as long as the width is formed to prevent the protrusion 37*c* from fitting in the groove 14*d* excessively. Additionally, the protrusion 37*c* is required to fit in the groove 14*d* adequately to prevent the attaching and detaching operation portion 23*p* from rotating, thus it is preferred to allow visual confirmation of the fitting state. With these aspects, the top surface portion 37*a* is formed in a narrower dimension than the width covering the whole upper side of the protrusion 37*c*, and is disposed deviating to the lateral direction from immediately above the protrusion 37*c* when the protrusion 37*c* is fitted in the groove 14*d*. This ensures the visual confirmation whether or not the protrusion 37*c* is fitted in the groove 14*d*.

Here, a case of the rotary shaft 35, the operating lever portion 36 and the stopper portion 37 being formed integrally of an identical material is indicated as an example, however, this should not be construed in a limiting sense; the rotary shaft 35, the operating lever portion 36 and the stopper portion 37 may be constituted of other materials as long as the rotary shaft 35, the operating lever portion 36 and the stopper portion 37 are coupled to one another and operate following one another.

According to the printer 1, there are cases where the platen roller portion 23 that is deteriorated is removed to be replaced with the new one, and the platen roller portion 23 is once removed for maintenance of the printing portion 11 and then reinstalled after the maintenance. In the techniques that the inventor has examined, the platen roller portion 23 is secured with screws, and when attaching and detaching the platen roller portion 23, it is necessary to perform the installing and removing operation using the screws. As a result, the operation is burdensome that consumes time and work. In contrast to this, according to the embodiment, the platen roller portion 23 can be attached and detached by operating the attaching and detaching operation portion 23*p*, thus the attaching and detaching operation becomes easier. It should be noted that the attaching and detaching operation of the platen roller portion 23 by the attaching and detaching operation portion 23*p* will be described later.

Disposing the attaching and detaching operation portion 23*p* outer side with respect to the support frames 14*a* in the axial direction of the platen roller portion 23 inhibits downsizing of the printer 1. In contrast to this, according to the embodiment, the attaching and detaching operation portion 23*p* is disposed between the bearing ring 23*b* and the platen main body 23*r* as described above to ensure the downsizing of the printer 1.

According to the embodiment, the attaching and detaching operation portion 23*p* is disposed at a position getting into a part of an area for a paper sheet (an area where the widest continuous paper P is fed). This reduces a dimension of the platen roller portion 23 in the axial direction compared with the case where the attaching and detaching operation portion 23*p* is disposed outside in the axial direction with respect to the paper sheet area, thus the printer 1 can be downsized.

Disposing the attaching and detaching operation portion 23*p* simply within the paper sheet area protrudes the attaching and detaching operation portion 23*p* above the top surface of the paper sheet guiding portion 24, and this may inhibit a normal flow of the continuous paper P. Therefore, according to the embodiment, a depressed portion 24*a* that houses the attaching and detaching operation portion 23*p* is disposed in a part within a feed surface of the continuous paper P on the paper sheet guiding portion 24. This prevents the attaching and detaching operation portion 23*p* from inhibiting the flow of the continuous paper P even though the attaching and detaching operation portion 23*p* is disposed within the paper sheet area since the attaching and detaching operation portion 23*p* can be housed in the depressed portion 24*a* while the platen roller portion 23 is locked (that is, during printing). Accordingly, the continuous paper P is fed normally, and then the proper printing is performed.

According to the embodiment, the operating lever portion 36 of the attaching and detaching operation portion 23*p* that is housed in the depressed portion 24*a* while the platen roller portion 23 is locked functions as a paper sheet guide. This ensures the normal flow of the continuous paper P.

In the case where having the operating lever portion 36 function as the paper sheet guide, it is required to lengthen an extension length of the operating lever portion 36 to some extent, but simply lengthening the extension length cannot maintain the mechanical strength of the operating lever portion 36 and this may cause a failure in functioning as the operating lever or may shorten its service life. On the other hand, making the operating lever portion 36 wider or thicker in order to ensure the mechanical strength is against the downsizing. Therefore, according to the embodiment, the cross-section of the operating lever portion 36 that crosses in the longitudinal direction is formed to be L-shaped as described above. This ensures the operating lever portion 36 both the mechanical strength and the downsizing at the same time even though the length of the operating lever portion 36 is lengthened to the extent that function as the paper sheet guide.

Furthermore, the flow of the continuous paper P is inhibited if a height of the top surface portion of the operating lever portion 36 is higher than the top surface of the paper sheet guiding portion 24, however, the flow of the continuous paper P may also be inhibited if the height of the operating lever portion 36 is low with respect to the top surface of the paper sheet guiding portion 24 because the operating lever portion 36 does not function as the paper sheet guide. Therefore, according to the embodiment, the stopper portion 37 is disposed to stop the height of the top surface of the operating lever portion 36 at the height that does not inhibit a move of the continuous paper P being fed onto the top surface of the paper sheet guiding portion 24, which is, for example, as high as or slightly lower than the top surface of the paper sheet guiding portion 24, when the platen roller portion 23 is locked and the attaching and detaching operation portion 23*p* is housed in the depressed portion 24*a*. That is, the operating lever portion 36 can be set to the height to function as a feed guide of the continuous paper P without caring. Then, the operating lever portion 36 functions as the paper sheet guide to ensure the normal flow of the continuous paper P.

Figure 18:
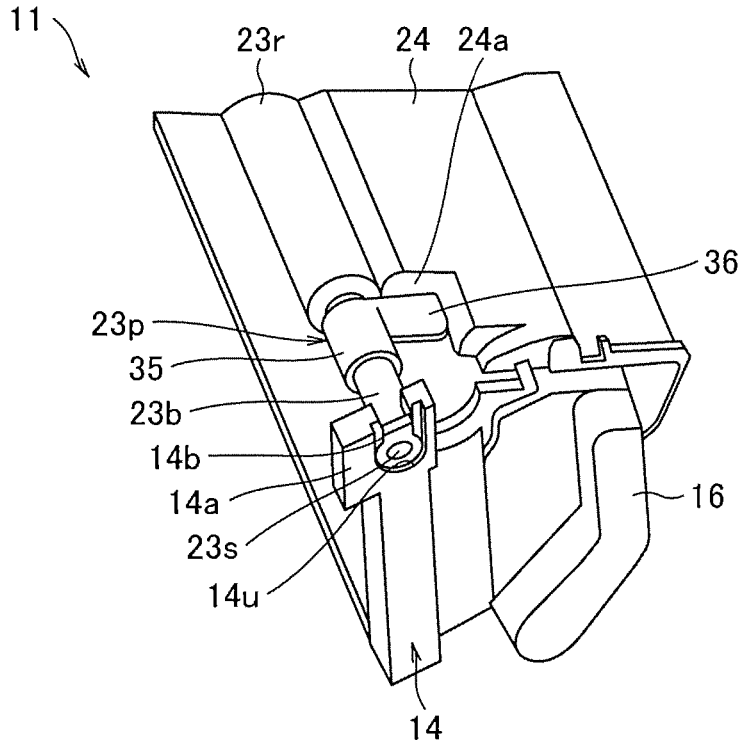
FIG. 18 is a perspective view of the corner portion of the supporting stand which constitutes the printing portion when attaching and detaching the platen roller portion.
Figure 19:
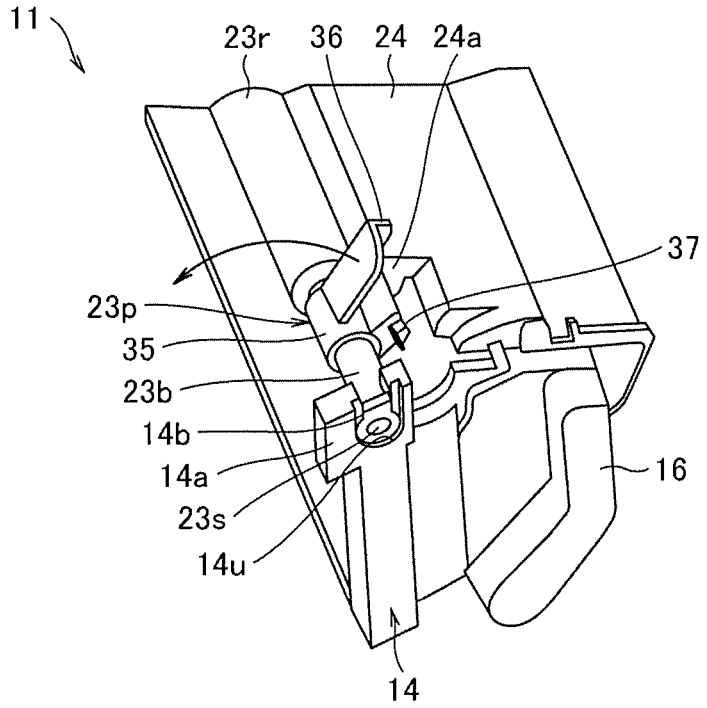
FIG. 19 is a perspective view of the corner portion of the supporting stand which constitutes the printing portion when attaching and detaching the platen roller portion, continued from FIG. 18.

Next, the attaching and detaching operation of the platen roller portion 23 will be described in reference to FIG. 18 and FIG. 19. FIG. 18 and FIG. 19 are perspective views of the corner portion of the supporting stand which constitutes the printing portion when attaching and detaching the platen roller portion.

As illustrated in FIG. 18, in the case where the platen roller portion 23 is fixed to the supporting stand 14, the operating lever portion 36 of the attaching and detaching operation portion 23*p* is laid toward the paper sheet guiding portion 24 and is housed in the depressed portion 24*a*.

When removing the platen roller portion 23, as illustrated in FIG. 19, pull the operating lever portion 36 of the attaching and detaching operation portion 23*p* to the near-side as an arrow indicates. Then, the rotary shaft 35 of the attaching and detaching operation portion 23*p* rotates around the platen shaft 23*s*, and following this rotation, the stopper portion 37 comes off of the shoulder portion 14*c* of the support frames 14*a*. This releases the locked state of the platen roller portion 23. Take the bearing rings 23*b* off of the grooves 14*b* of the support frames 14*a* by moving the platen roller portion 23 axially, and then, remove the platen roller portion 23 from the support frames 14*a*.

On the other hand, when installing the platen roller portion 23 in the support frames 14*a*, after inserting the right and left bearing rings 23*b* of the platen roller portion 23 in the right and left grooves 14*b* of the support frames 14*a*, push down the operating lever portion 36 of the attaching and detaching operation portion 23*p* toward the paper sheet guiding portion 24. Then, the rotary shaft 35 of the attaching and detaching operation portion 23*p* rotates around the platen shaft 23*s*, but the rotation stops by the top surface portion 37*a* and the side surface portion 37*b* of the stopper portion 37 abutting on the top surface and the side surface of the shoulder portion 14*c* and the protrusion 37*c* of the stopper portion 37 fitting in the groove 14*d* of the shoulder portion 14*c* while rotating. This houses the operating lever portion 36 in the depressed portion 24*a* and installs the platen roller portion 23 in the support frames 14*a*.

Thus, according to the embodiment, when attaching and detaching the platen roller portion 23, no burdensome operation, such as removing screws, is required, but only operating the attaching and detaching operation portion 23*p* easily attaches and detaches the platen roller portion 23.

When installing the platen roller portion 23, the operator just push the operating lever portion 36 to the position where the rotation of the operating lever portion 36 stops to set the operating lever portion 36 at the appropriate position without caring the height of the top surface of the operating lever portion 36 and the rotation position. Accordingly, the installation operation of the platen roller portion 23 can be even easier.

A configuration and an operation manner of the attaching and detaching operation portion 23*p* are simple, thus disposing the attaching and detaching operation portion 23*p* does not make a configuration of the platen roller portion 23 complicated.

As described above, the invention made by the present inventor has been described specifically based on the embodiment. However, it should be understood that the embodiment disclosed herein is for illustrative purposes in all respects, and is not limited to the technique disclosed. That is, the technical scope of the present invention should not be construed in a restrictive manner based on the description in the embodiment, should be construed in accordance with the description in a range of the claim as a principle, and the technique identical to the technique disclosed in a range of the claim and all changes within the scope of the claim are included.

According to the embodiment, a case that a continuous paper, which includes a plurality of labels adhered temporarily on a liner sheet, is used as a print medium has been described, but this should not be construed in a limiting sense; for example, a continuous label including an adhesive surface on one surface (label without liner sheet), a continuous sheet without an adhesive surface (continuous sheet), or, not limited to papers, a printable film by a thermal head or a similar film can be used as a print medium. The label without liner sheet, the continuous sheet, or the film can include a position detection mark. In the case where the label without liner sheet, where an adhesive is exposed, or a similar label is fed, a roller including silicone may be disposed while a non-adhesive coating is applied to a feed path.

In the above description, the present invention has been described in a case applying to a stand-alone type printer, where an input operation to the printer is executed without a personal computer, but this should not be construed in a limiting sense; for example, the present invention may also apply to an on-line type printer, where the input operation to the printer is executed via the personal computer.

This application claims the priority based on Patent Application No. 2013-268260 filed in the Japan Patent Office on Dec. 26, 2013, and every content of this application is incorporated herein by reference.

The invention claimed is:

1. A printer comprising:

a printing unit that performs printing on a print medium while feeding the print medium supplied from a medium supply unit along a medium feed path;

a platen roller portion disposed at an opposite position of the printing unit in the medium feed path, the platen roller portion feeding the print medium along the medium feed path;

a support body that axially supports the platen roller portion in a rotatable state; and a medium guiding portion that guides feeding of the print medium to an upstream side of the feed with respect to the platen roller portion, wherein the platen roller portion includes:

a platen main body;

a platen shaft that projects from both ends in an axial direction of the platen main body;

bearing portions mounted on the platen shaft at each of both ends in the axial direction of the platen main body in a rotatable state, the bearing portions being supported by the support body; and an operating portion disposed in the platen shaft of the platen roller portion in a rotatable state, the operating portion operating to attach and detach the platen roller portion, wherein the medium guiding portion is disposed with a depressed portion housing the operating portion.

2. The printer according to claim 1, wherein the depressed portion housing the operating portion is disposed in a part within a feed surface of the medium guiding portion.

3. The printer according to claim 1, wherein the operating portion comprises:

an operating lever portion; and a stopper portion for fixing the operating portion, the stopper portion being coupled to the operating lever portion.

4. The printer according to claim 3, wherein:

the stopper portion is disposed with a protrusion, and the support body is disposed with a depressed portion where the protrusion of the stopper portion fits.

5. The printer according to claim 3, wherein the stopper portion is disposed such that a height of a top surface of the operating lever portion stops at a height that does not inhibit a move of the print medium being fed onto a top surface of the medium guiding portion when the operating portion is housed in the depressed portion.

6. The printer according to claim 1, wherein the operating portion is disposed in a rotatable state between the platen main body and the bearing portion on one end side in a direction of the platen shaft.

* * * * *